US006135199A

United States Patent [19]

Wyatt-Mair

[11] Patent Number: 6,135,199

[45] Date of Patent: Oct. 24, 2000

[54] COOLING DEVICE FOR BELT CASTING

[75] Inventor: Gavin Wyatt-Mair, Lafayette, Calif.

[73] Assignee: Alcoa Inc., Pittsburgh, Pa.

[21] Appl. No.: 09/196,124

[22] Filed: Nov. 20, 1998

Related U.S. Application Data

[60] Provisional application No. 60/065,250, Nov. 20, 1997.

[51] Int. Cl.[7] ..... B22D 11/055; B22D 11/06

[52] U.S. Cl. ..... 164/481; 164/485; 164/443; 164/431; 164/432

[58] Field of Search ..... 164/485, 443, 164/481, 431, 432

[56] References Cited

U.S. PATENT DOCUMENTS

| | | | |
|---|---|---|---|
| 4,934,443 | 6/1990 | Honeycutt, III et al. | 164/479 |
| 5,356,495 | 10/1994 | Wyatt-Mair et al. | 148/551 |
| 5,363,902 | 11/1994 | Kush | 164/485 |
| 5,389,372 | 2/1995 | deMaria et al. | 424/195.1 |
| 5,470,405 | 11/1995 | Wyatt-Mair et al. | 148/551 |
| 5,496,423 | 3/1996 | Wyatt-Mair et al. | 148/551 |
| 5,514,228 | 5/1996 | Wyatt-Mair et al. | 148/551 |
| 5,515,908 | 5/1996 | Harrington | 164/481 |
| 5,564,491 | 10/1996 | Harrington | 164/481 |

FOREIGN PATENT DOCUMENTS 0 583 867 2/1994 European Pat. Off. .

OTHER PUBLICATIONS

D. Reed Von Gal, "Twin–Belt Aluminum Casting– A technology Which Has Come of Age", Light Metal Age, (Apr. 8, 1989).

"Progress Report on the Use of the Hazelett Process for Aluminum Alloy Strip–Casting", C.J. Petry et al., Hazelett Strip–Casting Corporation, Colchester, Vermont.

*Primary Examiner*—Kuang Y. Lin

*Attorney, Agent, or Firm*—Jones, Tullar & Cooper PC

[57] ABSTRACT

Method and device for cooling belts of single or twin belt casters. The belt is cooled by a liquid which is contacted with the inner surface of the belt by a system of feed tubes and collection tubes. Liquid is passed out the feed tube, into a channel that communicates with the inner surface of the heated belt, the belt is cooled, and the liquid is removed through collection tubes with a vacuum assist.

26 Claims, 6 Drawing Sheets

COOLING DEVICE FOR BELT CASTING

This application claims priority under 35 U.S.C. §§119 and/or 365 to U.S. Provisional Application Ser. No. 60/065,250 filed on Nov. 20, 1997; the entire content of which is hereby incorporated by reference.

FIELD OF THE INVENTION

This invention relates to a method and apparatus for the continuous casting of metals, and particularly the casting of metal strip. More specifically, the invention relates to the cooling of casting belts used in the continuous casting of metals.

BACKGROUND OF THE INVENTION

The continuous casting of thin metal strip has been employed with mixed success. Prior processes for the continuous casting of metal strip have been limited to a relatively small number of alloys and products. It has been found that as the alloy content of various metals are increased, the surface quality of the strip deteriorates. As a result, many alloys must be fabricated using ingot methods.

Relatively pure aluminum product such as foil can be continuously strip cast on a commercial basis. Building products can be continuously strip cast, principally because surface quality in the case of such building products is less critical than in other aluminum products, such as can stock. However, surface quality problems appear as the alloy content of aluminum is increased and strip casting has generally been unsuitable for use in malting many aluminum alloy products.

A number of continuous casting machines have been proposed in the prior art. One conventional device is a twin belt strip casting machine, but such machines have not achieved widespread acceptance in the casting of many metals, especially not with metal alloys with wide freezing ranges. In this twin belt strip casting equipment, two moving belts define a moving mold for the metal to be cast. Many prior art processes cool the belts in the area adjacent to the solidification. However, the belt is subjected to extremely high thermal gradients because molten metal is in contact with one side of the belt and a coolant is in contact with the other side of the belt. The dynamically unstable thermal gradients cause distortion in the belt, and consequently neither the upper nor the lower belt is flat. Consequently, the cast metal strip has areas of segregation and porosity.

There are systems that are much more effective at continuous strip casting because they cool the belts when they are not in contact with the solidifying or solid metal. These devices are shown in the following United States patents, which are all incorporated by reference in their entireties: U.S. Pat. Nos. 5,470,405; 5,514,228; 5,515,908; 5,564,491; 5,496,423; 5,363,902; and 5,356,495. U.S. Pat. No. 5,363,902 shows a cooling system in which a cooling box is placed on the belt when the belt is not in contact with the solidifying or solid metal. However, there still remains a need to produce an apparatus that can cast an alloy with acceptable surface properties using belts that do not have distortion.

SUMMARY OF THE INVENTION

The invention provides a device for cooling a belt used in continuous casting. It comprises two or more pulleys to hold and move a belt, comprising an entry and exit pulley. The exit pulley comprises a plurality of circumferential channels in its outer surface which are in open contact with the inner surface of the belt. The channels run in a direction that is circular on the outer surface of the pulley, and the channels comprise liquid feed and collection tubes for liquid passage, so that the liquid flows from the feed to the collection tube while contacting and cooling the inner surface of the belt.

Among other factors, it has been discovered that the present invention can cool the belts used in continuous casting while minimizing belt distortion and fluid leakage onto the belt casting surfaces, while keeping the belt temperature uniform and in the appropriate temperature range to continuously cast metal.

More specifically, the invention provides a method and device for cooling a belt used in twin belt or single belt continuous casting. In the twin belt caster, two or more pulleys including an entry and exit pulley hold and move an upper belt and two or more pulleys including an entry and exit pulley hold and move a lower belt. The upper and lower belts have inner and outer surfaces and the exit pulleys comprise a plurality of circumferential channels in an outer surface which are in open contact with the inner surface of the upper and lower belts. The channels comprise liquid feed and collection tubes for liquid passage, the feed tube releasing liquid and the collection tube taking up liquid, so that the liquid flows from the feed to the collection manifold while directly contacting and cooling the inner surface of the belt. A vacuum operably connected to the collection tubes assists in the collect of liquid and a squeegee arranged to contact the inner surface of the upper and lower belts can be provided to remove any excess liquid that was not taken up by the collection tubes.

BRIEF DESCRIPTION OF THE DRAWINGS

FIGS. 5 and 6 are cross sectional views of a pulley having grooved channels in its surface with feed/collection tubes lying therein wherein FIG. 5 shows squared channels and FIG. 6 shows rounded channels.

DETAILED DESCRIPTION OF THE INVENTION

Figure 1:
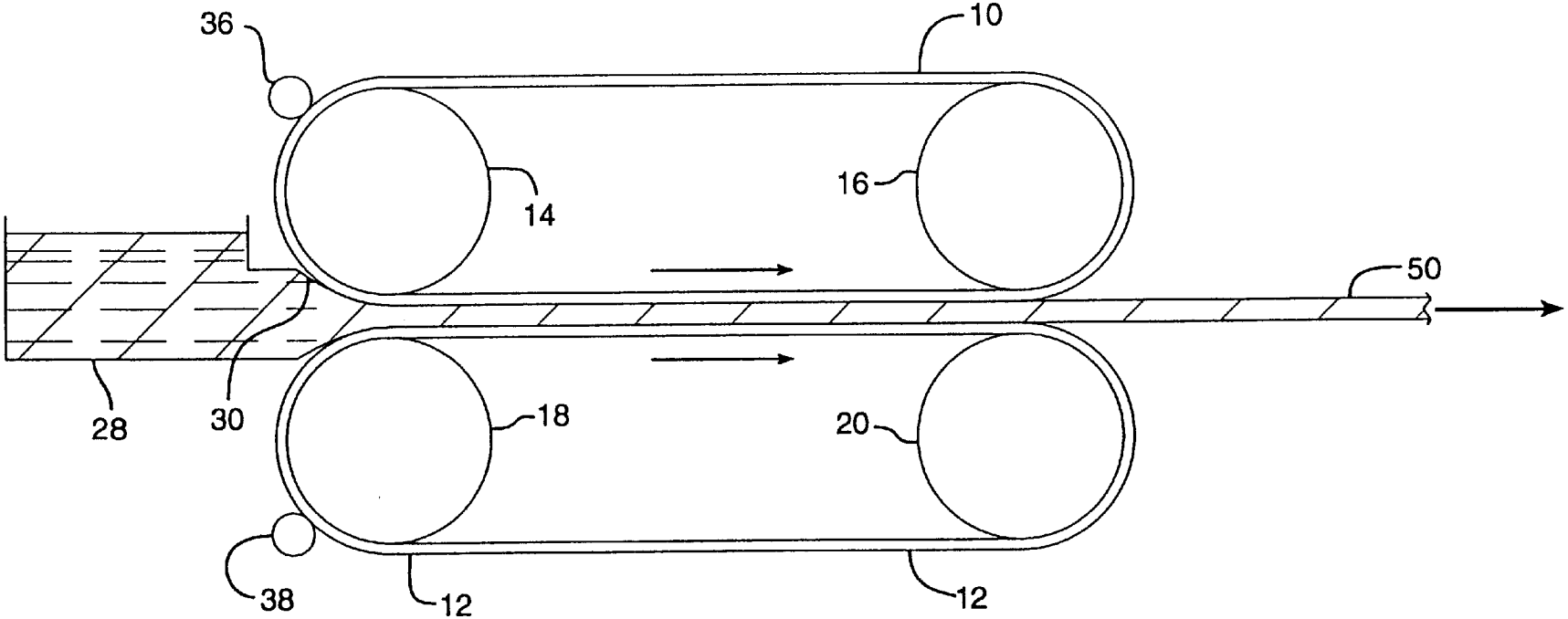
FIG. 1 is a schematic illustration of a caster used in a preferred embodiment.

The present invention is used in the strip casting of metals by continuous single or twin belt casting. The preferred twin belt strip casting device uses a pair of belts formed of a heat conductive material positioned adjacent to each other to define a molding zone. The belts are mounted on at least two pulleys and each belt passes around a first or entry pulley to define a curved surface and a substantially flat, and preferably horizontal, surface after the belt passes around the second, or exit, pulley. The preferred device also employs a device supplying molten metal to the curved surfaces of the belts whereby the molten metal solidifies on the surface of the belts in the molding zone to form a cast strip of metal. The molten metal thereby transfers heat to the belts. Substantially all of the heat transfer to the belts is removed from the belts while they are out of contact with the molten metal and the cast strip. The preferred single belt casting device is arranged and operates like the lower belt of a twin belt casting device.

Preferably, the molten metal is supplied to the belt on the curved section around the entry pulley. In some conventional belt casters of the prior art, the metal is supplied to the belt in the straight section of the belt after it passes around the entry pulley and cooled concurrently from the backside as solidification occurs. Supplying molten metal to the curved section of the belt has the advantage of increased mechanical stability to resist thermal distortions of the casting belt, maintenance and more uniform thickness of the strip and better thermal contact between the strip and belt. These advantages improve the cast strip surface quality.

Preferably, the device includes two belts. The more preferred caster is horizontal with one belt being positioned above the other to define a substantially horizontal molding zone between the upper and lower belts. However, it should be appreciated that a vertical caster can be used with the present invention. The supply of molten metal comes from a conventional tundish provided with a nozzle through which the molten metal flows in a stream into the space defined between the belts preceding the nip of the entry pulleys. The molten metal solidifies in the molding zone defined by the nozzle and the belts passing around the entry pulleys. The cast strip is substantially solidified by the time it reaches the nip of the entry pulleys on which the belts are mounted. The horizontal stream of molten metal flowing into the space between the belts preceding the nip insures that the molten metal is always maintained in contact with the surface of both belts as the metal is being cast.

Specifically, the invention provides a cooling device which continuously cools a belt by a cooling liquid in which the temperature of the belt is accurately controlled. If desired, the temperature of the belt can be monitored with a suitable temperature sensing arrangement and belt temperature can be controlled by adjusting the flow rate of liquid through the cooling device. Additionally, the liquid is contained within the cooling device without leakage onto the strip so that there is no need to employ complex and costly seals. Furthermore, the casting surface is not exposed to the cooling water so that contaminants that are present in the water are not deposited on the casting surface.

The casting process requires that the heat transferred from the product is extracted by quenching the belts in a controlled manner. The belt temperature must be accurately controlled because it is critical to the process, affecting the thickness and temperature of the strip being produced. The present invention provides for the maintenance of uniform temperatures over the length and width of the belt. The cooling device according to the invention obviates the need for cooling of the belt at other locations such as along the flat section in contact with the cast strip or along the other flat section not in contact with the cast strip.

The liquid (as the quenching or cooling media) is preferably contained within the cooling device. In the case of belt quenching, it is preferred that no trace of quenching medium is allowed to enter the region of molten metal introduction for reasons of surface quality and safety.

The absence of fluid cooling, while the belt is in contact with hot metal in the molding zone, significantly reduces thermal gradients and eliminates problems of film boiling occurring when the critical heat flux is exceeded. The present invention also minimizes cold framing, a condition where cold belt sections exist in three locations, namely (1) before metal entry and 2) on each of the two sides of mold zone of the belt. Those conditions can cause severe belt distortion. The present invention also allows for extended surface area for extracting heat from the belt based on up to half the circumference of the exit pulley.

Figure 6:
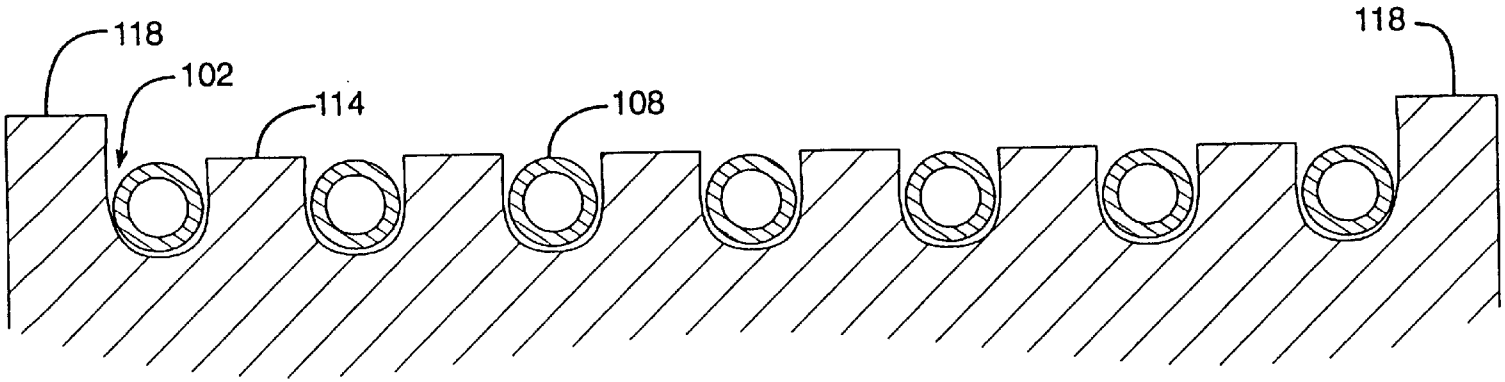

It is also possible to employ the concepts of the present invention in a method and apparatus utilizing a single belt, such as that described in U.S. Ser. No. 08/629,380, which is hereby incorporated by reference in its entirety. Another embodiment is schematically illustrated in FIG. 6 of the drawings in U.S. Pat. No. 5,363,902, which is hereby incorporated by reference in its entirety. In that embodiment, a single belt is mounted on a pair of pulleys, each of which is mounted for rotation about an axis. Molten metal is supplied to the surface of the belt by means of a tundish. Cast product exits the top surface of belt. The device of the present invention serves to cool the belt when it is not in contact with the molten metal on the belt. The cooling device is placed in the exit pulley and/or entrance pulley.

Figure 2:
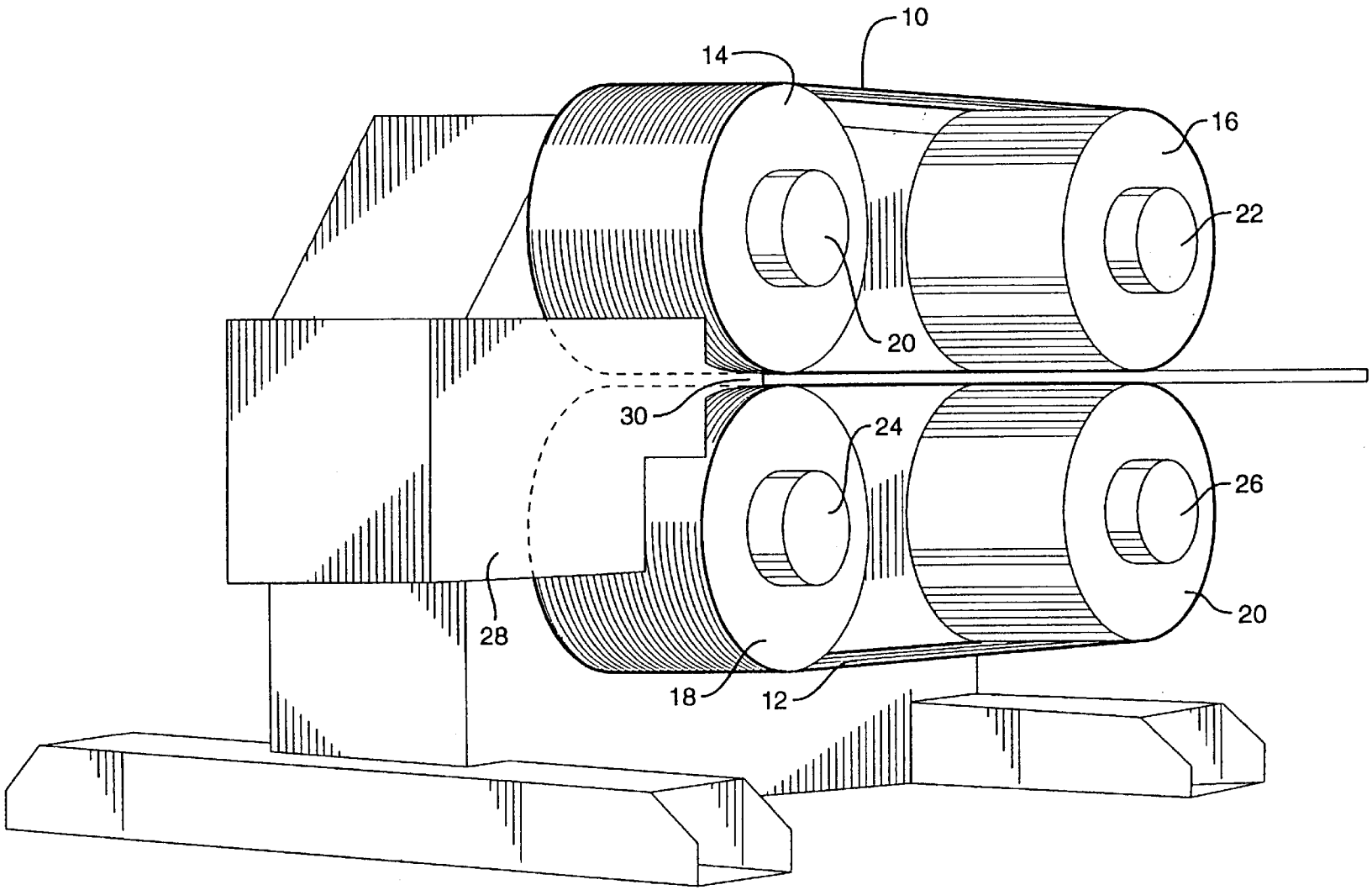
FIG. 2 is a perspective view of a caster used in a preferred embodiment.

A preferred caster is generally illustrated in FIGS. 1 and 2 of U.S. Pat. No. 5,515,908 (the '908 patent), which is hereby incorporated by reference in its entirety. FIGS. 1 and 2 of the '908 patent are similar to the present FIGS. 1 and 2. Both show the preferred device to include a pair of endless belts 10 and 12 carried by a pair of upper pulleys 14 and 16 and a pair of corresponding lower pulleys 18 and 20. The entrance pulleys are 14 and 18 and the exit pulleys are 16 and 20. Other features of the caster include a tundish 28, a casting nozzle 30, scratch brush means 36, 38, and the cast strip 50. As shown in FIG. 2, each pulley is mounted for rotation about an axis 20, 22, 24, and 26. The pulleys are of a suitable heat resistant type of material, and either or both of the upper pulleys 14 and 16 is driven by a suitable motor arrangment not illustrated in the drawing for purposes of simplicity. The same is equally true for the lower pulleys 18 and 20. The upper belt 10 and the lower belt 12 are endless belts, and are preferably formed of a metal which has low reactivity or is non-reactive with the metal being cast. Quite a number of suitable metal alloys may be employed as well known by those skilled in the art. Good results have been achieved using steel and copper alloy belts.

For some applications, it can be desirable to employ one or more belts having very fine longitudinal grooves on the surface of the belt in contact with the metal being cast. These lines/grooves affect the surface texture of the metal being cast. Such grooves have been used in single drum casters as described in U.S. Pat. No. 4,934,443. For a preferred belt, see U.S. Ser. No. 08/543,445, which is hereby incorporated by reference in its entirety.

Figure 4:
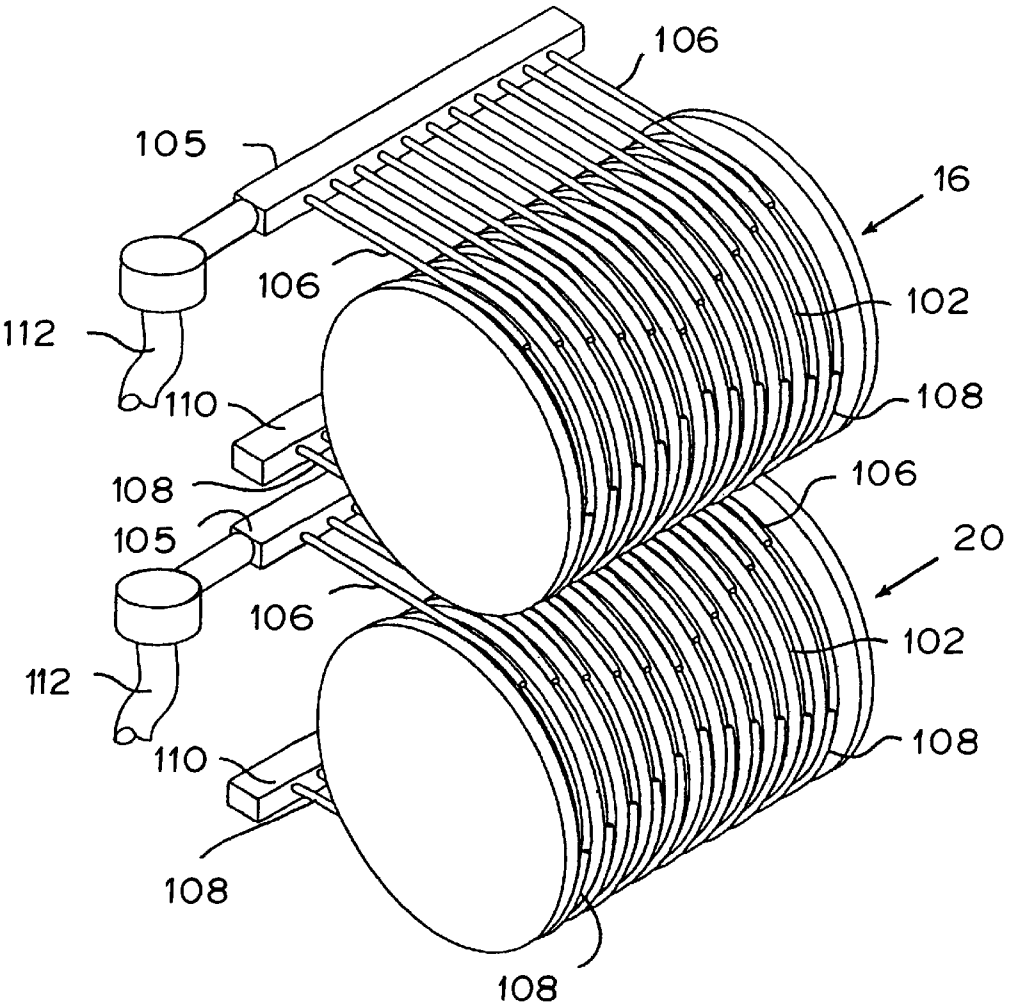
FIG. 4 is a perspective view of a preferred embodiment where an upper and a lower exit pulley are shown with the inventive cooling device, wherein the length of the tubes has been varied to affect the cooling zone.

A corresponding set of backup rolls can be mounted in tangential contact with the upper belt and thus serve to exert sufficient pressure on the belt to maintain the belt in contact with the strip as it is transformed from molten metal to a solid strip (See FIG. 4 of the '908 patent). Preferably, the upper set of backup rolls are set in vertical slots so that gravity acts to close the gap and retain some thermal contact between the belts and the cast strip.

Figure 3:
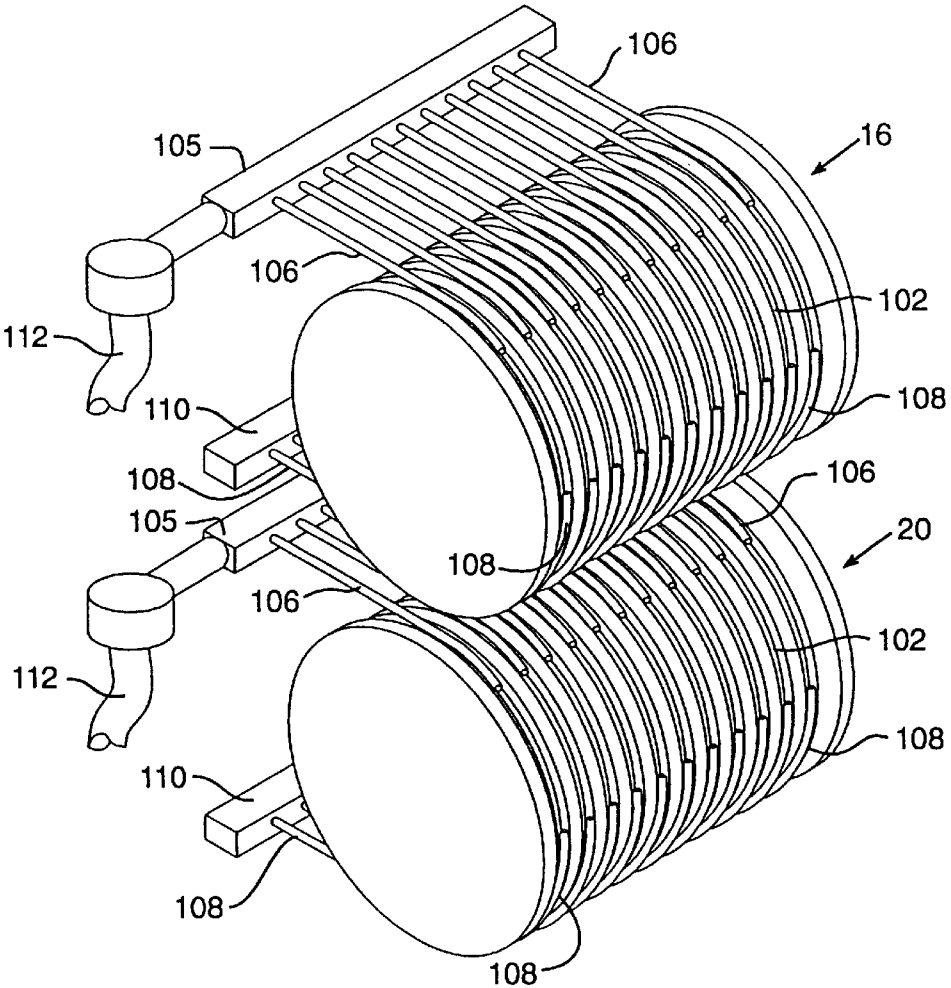
FIG. 3 is a perspective view of a preferred embodiment where an upper and a lower exit pulley are shown with a cooling device in accordance with the invention.

The nozzle and the belts preferably define a molding zone into which the stream of molten metal flows in a substantially horizontal orientation from the nozzle to fill the molding zone between the curvature of each belt to the nip of the pulleys (See FIG. 3 of the '908 patent). The molten metal begins to solidify and is substantially solidified by the point at which the cast strip reaches the nip of the pulleys. Belt distortion is limited by supplying the horizontally flowing stream of molten metal to the molding zone where it is in contact with a curved section of the belts passing about pulleys.

It has been found that aluminum strip having a thickness of 0.100 inches using steel belts having a thickness of 0.08 inches provides a return temperature of 300° F. and an exit temperature of 800° F. The interrelationship of the exit temperature with belt and strip thickness is described in more detail with reference to FIGS. 7 and 8 of European Patent Publication EP 583 867, and in copending counterparts, U.S. Ser. Nos. 07/902,997, 08/184,581, 08/184,870, 08/799,448, all of which are hereby incorporated by reference in their entireties. For example, for casting aluminum strip having a thickness of 0.100 inches using a steel belt having a thickness of 0.06 inches, the exit temperature is 900° F. when the return temperature is 300° F. and the exit temperature is 960° F. when the return temperature is 400° F.

Preferably, the present caster includes a device along the edges of the belts to prevent the molten metal from flowing outwardly in a transverse direction from the belt. A conventional edge dam can be employed, such as those found on twin drum casting machines. The edge dam is composed of a pair of walls extending perpendicularly from the surfaces of the belts to prevent the flow of molten metal outwardly from the molding zone. Materials used for edge dams include titanium, carbon fiber, stainless steel, high strength carbon steel, iron, and any of these materials coated with one or more elements for plating, such as chromium, and zinc, etc.

The preferred cooling device of the present invention involves a device that is different from that shown in the '908 patent. The presently preferred cooling device is preferably employed in the exit pulleys 16 and 20. Present FIGS. 3–6 show preferred embodiments of the invention.

FIG. 3 shows the upper 16 and lower 20 exit pulleys with the belts removed to show an embodiment according to the present invention. The preferred cooling device cools the belts before they come into contact with the molten metal again. The cooling device is preferably employed in the exit pulleys 16 and 20. However, a less preferred embodiment can employ the cooling device in the entrance pulleys 12 and 14 or in the entrance and exit pulleys. However, if the cooling means is in the entrance pulleys 12 and 14, the cooled section of the belts is preferably not in contact with the molten metal. The cooling device preferably comprises an arrangement to bring a cooling liquid in direct contact with the inner side of the belts to remove heat. A preferred device employs circumferential grooves or channels 102 in the exit pulleys 16 and 20 and feed 106 and collector tubes 108 in the channels 102. Preferably, liquid passes from a supply manifold 105, into a feed tube 106, into the channel 102 where it contacts and cools the belt, then to a collection tube 108, and a suction manifold 110. Preferably, the collection tube 108 has a vacuum assist (through an aspirator or eductor) to aid in the uptake of the liquid from the cooling device. It is highly desirable that care be taken to avoid liquid spillover onto the outer surface of the belt so that neither water, nor any contaminants in the water, are left on the belt. The above manifolds and tubes may be constructed in many shapes, cross-sections, sizes, and of many materials. Generally, designs will be employed that accomplish the stated purpose, which is to effectively cool the belt while producing a thin sheet of metal that is acceptable for its purpose. Furthermore, a water supply or recovery hose 112 can be connected to the manifolds 105, 110 to supply or remove fluid. While the hose is shown attached to the supply manifold 105, a recovery hose may likewise be connected to the other side of the suction manifold.

Figure 4A:
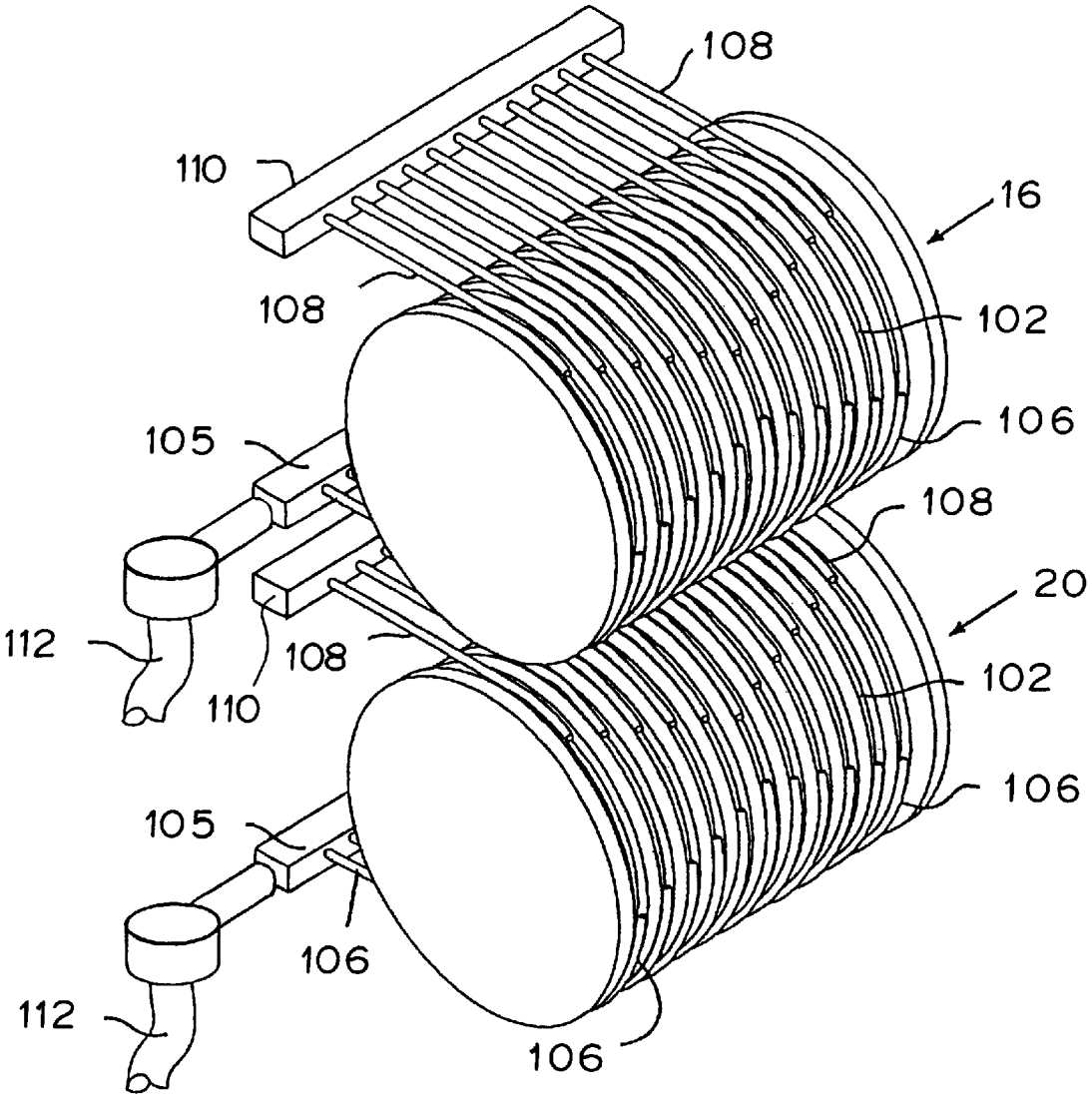
FIG. 4*a* is a perspective view of a preferred embodiment where an upper and a lower exit pulley are shown with the inventive cooling device, wherein the feed tubes are located at a lower position on the pulley than the collection tubes.

The feed 106 and collection tubes 108 can be oriented so that the flow can be in the same direction, as illustrated in FIG. 4 or opposite to the direction, as illustrated in FIG. 4*a* movement of the belt. The belt and fluid direction will affect the fluid pressure on the collection tube 108. For example, the velocity of the liquid is similar to the belt when the flow is in the same direction as the belt. However, the liquid velocity will need to be higher if the flow runs in a direction counter to the belt, such as 400–600 feet per minute (fpm) of the liquid. Preferably, the water supply pressure to the supply manifold 105 is in the range of 50 to 85 psig. The supply pressure is dictated by the supply pump pressure which is preferably around 65 psig. The preferred vacuum at the suction manifold 10, is no more than 15 psia, more preferably no more than 10 psia. Preferably, the fluid pressure is no less than 3 psia, more preferably, no less than 7 psia. A pressure of 4 psia is preferable at the suction manifold 110 for water removal efficiency. As one skilled in the art will appreciate, when the pressure is reduced, water will boil at a lower temperature. This variable should be considered when calculating the final temperature that is desired for the belts. Additionally, the flow can be oriented in relation to gravity. In one embodiment, the feed tubes 106 are located on the exit pulleys 16 and 20 of the horizontal caster at a point that is lower than the collection tubes 108. In this embodiment gravity lowers the fluid pressure at the collection tube 108 so that the possibility of leaks is reduced. The feed 106 and collection tubes 108 can be located virtually anywhere on the exterior of the exit pulleys 16 and 20 as long as they are positioned so that fluid can flow from the feed 106 to the collection tube 108 while contacting the inner surface of the belt so that the entire belt is cooled.

Preferably, the longest section of the belt to be cooled is no more than approximately 180° of the circumference of the pulley, more preferably, no more than 165°. Preferably, the cooled section is no less than 30°, more preferably, no less than 45°. The section of the belt that is cooled can be adjusted based on the desired final cooling temperature. With reference to FIG. 4, for example, the distance, or angle, between various feed 106 and collection tubes 108 can be varied to change the length of the channel 102 that contains fluid and therefore to effect more, or less, cooling. For example, the distance (and angle) between the feed 106 and collection tubes 108 on the outer edge of the pulley may be shorter (and smaller) than the distance (and angle) between the interior tubes. It will be apparent to those skilled in the art that the design of the cooling tube arrangement can be optimized to achieve a desired cooling profile on the belt.

In a preferred embodiment, the tubes are located in a plurality of channels 102. For example, one channel can be provided for every feed/collection tube pair. However, alternative embodiments could encompass one large channel or less channels than the number of tubes, it being desirable that the belt is cooled appropriately and liquid does not leak from the cooling device. The channels 102 are preferably oriented in a circumferential relationship along the exterior surface of the pulleys. Exterior surface is defined to include the channels 102 which, for example, can have a depth of up to 1 inches in the outer surface of the pulley. For example, the channel can be 1 inch or even ⅝ inch deep. Preferably, the channel is at least ¼ inch, more preferably at least ½ inch deep. A preferred channel arrangement is shown in FIGS. 3–6 where the channels trace a circumferential line along the curved surface of the pulley.

In accordance with a preferred embodiment, the channels 102 have the same widths and are spaced apart by a uniform distance which can be smaller, the same or larger than the width of the individual channels. In another embodiment, the channels are separated by the same or different distances. Accordingly, the ratio of the land-to-groove area formed by the channels can be optimized for minimizing hot spots on the belt while simultaneously maximizing mechanical support for the tensioned belt.

Figure 5:
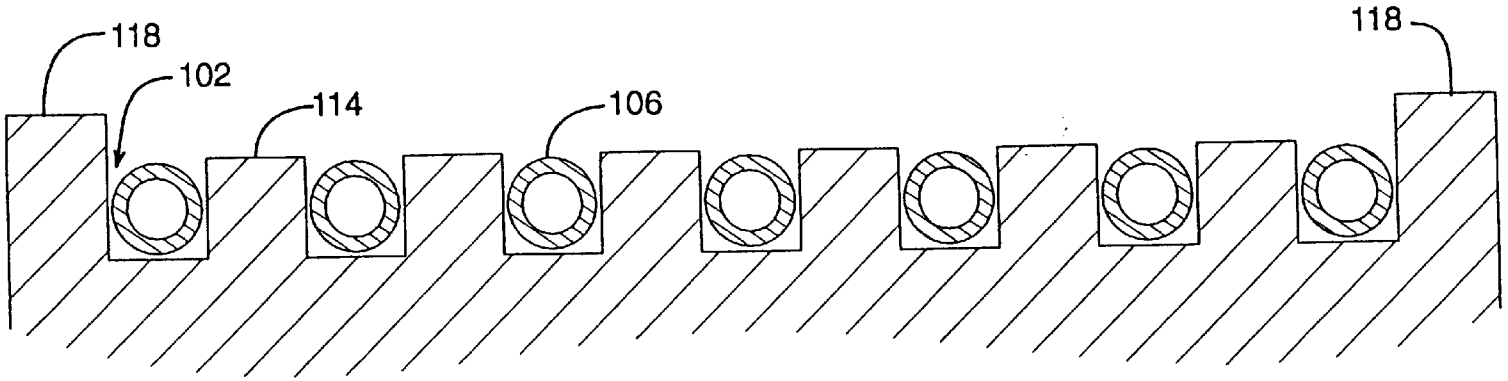

Reference is now made to FIGS. 5 and 6 which show a cross section of the exit pulley 16, 20 at the surface of the pulley. The channels 102 serve to direct the liquid flow and the channel supports or sides 114, define the channels 102 and provide support to the belt. Additionally, the outside channel 102 provides a shoulder 118 for the belt to seal the liquid into the channel 102. Preferably, the shoulder 118 is higher and may be wider than the other channel supports 114. Preferably, the shoulder 118 is between 0.005 to 0.020 inches higher and may optionally be between 0.005 to 0.030 inches wider than channel supports 114. It is also possible to completely eliminate the shoulder, in another embodiment, which would allow the edge of the belt to be unsupported. Furthermore, to the extent that the liquid is prevented from directly contacting the belt, there may be hot spots of higher temperature at locations where the belt contacts the channel supports 114. These hot spots are dissipated by heat conduction with cooler sections of the belt. However, the hot spots may not be sufficiently dissipated in entrance pulley coolers because the cooling section is much smaller and cooling needs to be more intense. For example, the molding zone is typically 3 to 5 inches on an entrance pulley.

The preferred cross-sectional shape of the channels 102 is rectangular as shown in FIG. 5 or curved as shown in FIG. 6. The channel 102 should be able to accommodate fittings (not shown) located in the grooves for the feed 106 and collection tubes 108. Preferably, the shape of the fitting seals the end of the groove to minimize leakage of liquid from the groove. For example, the fittings can be ½ inch square pieces with a threaded opening receiving the feed or collection tube and an outlet for feeding or removing liquid from the groove. In the preferred embodiment, the fittings are rectangular, can accommodate the tubes and are made of a material that is compatible with the metal of the pulley. That is, because it is desirable for the fitting to make a good sliding fit between the groove in the pulley and the belt passing around the pulley, it is also desirable for the fitting to be self-lubricating and avoid galling. The preferred fitting is made of brass. Additionally, the pulley can be plated with a metal such a chromium. However, the fitting can be made of other materials which minimize wear and friction, maximize robustness and minimize distortion. Examples of alternative materials include bronze, graphite, plastic such as "TORLON", etc.

The preferred liquid that is used to cool the belt is water, as it is the most practical industrial coolant. However, other additives may be used alone, or in combination with water (in solution or mixed together). The other additives can include common coolants, such as glycols, sodium carbonate, rust inhibitors, oils, etc.

Preferably, in the case of casting aluminum, the amount of water is related to the speed and the heat of the belt to achieve a final belt temperature of no more than 300° F., more preferably, no more than 260° F. Preferably, the belt temperature is no less than 160° F., more preferably, no less than 230° F., most preferably, no less than 240° F. Preferably, the temperature is high enough so that any moisture on the casting surface is evaporated. For example, if the coolant is above its boiling point, e.g., above about 210° F. in the case of water, any water which remains on the belt can be quickly evaporated and thus avoid contamination of the cast strip.

Another method to reduce the possibility of fluid leaking onto the belts is by increasing the belt tension. Preferably, the belt tension is as high as is practical for the equipment. A preferred belt tension is at least 20,000 psi, more preferably it is at least 30,000 psi. Preferably, the belt tension is no more than 90,000 psi, more preferably no more than 60,000 psi. Additionally, a cleaning device such as a squeegee can be positioned on the inner surface of the belts after they leave the pulley. Air discharge equipment can also be used to dry the inner surface free of any remaining water. The tension, squeegee, and the air discharge equipment are examples of techniques to remove any excess liquid that was not taken up by the collection tube from the inner surface of the upper and lower belts. A device similar to that shown in U.S. Pat. No. 5,389,372 could be used because the intent would be to remove liquid from the surfaces and the sides of the belt.

The present cooling device and process will now be illustrated by reference to the following example which sets forth a particularly advantageous embodiment. However, it should be noted that this embodiment is illustrative and is not to be construed as restricting the invention in any way. However, it should be noted that this embodiment is illustrative and is not to be construed as restricting the invention in any way.

EXAMPLE

A continuous caster similar to that shown in U.S. Pat. No. 5,515,908 was used to melt and cast metal. The quench system of the present invention was employed to cool a continuous steel belt having a width of 9 inches and a thickness of 0.080 inches. The belt was operated at a linear speed of 280 feet per minute and was cooled using a water supply of 60 g.p.m. It was found that complete containment of the water coolant was achieved in all tests. Furthermore, the cast aluminum strip was of an acceptable quality.

The present invention has been described with referenced to specific embodiments. However, those applications are intended to cover those changes and substitutions which may be made by those skilled in the art without departing from the spirit and scope of the appended claims.

What is claimed is:

1. A continuous casting apparatus for cooling a belt used in continuous casting, comprising:

two or more pulleys to hold and move a belt, comprising an entry and exit pulley;

the belt comprises an inner and outer surface;

the exit and/or entrance pulley comprises at least one channel which is in open contact with the inner surface of the belt, the channel runs on the exterior surface of the pulley; and the channel contains at least one liquid feed tube and at least one collection tube for liquid passage, so that the liquid flows in the channel from the feed tube to the collection tube while directly contacting and cooling the inner surface of the belt.

2. A continuous casting apparatus in accordance with claim 1 wherein there are a plurality of channels.

3. A continuous casting apparatus in accordance with claim 2 wherein there is a feed and collection tube for every channel requiring cooling.

4. A continuous casting apparatus in accordance with claim 1 wherein a vacuum is operably connected to the collection tube.

5. A continuous casting apparatus in accordance with claim 4 wherein the vacuum pulls between 15 and 3 psia.

6. A continuous casting apparatus in accordance with claim 2 wherein the channels extend circumferentially around the surface of the pulley.

7. A continuous casting apparatus in accordance with claim 2 wherein the feed tubes are located at a lower position on the pulley than the collection tubes.

8. A continuous casting apparatus in accordance with claim 1 wherein the pulley has an outer channel which has an outer shoulder that is higher and optionally wider than the portions of the pulley which define the channels.

9. A continuous casting apparatus in accordance with claim 1 wherein the section of belt that is cooled is a circumferential section which extends between 180° and 30° of the pulley circumference.

10. A continuous casting apparatus in accordance with claim 1 wherein the belt is cooled to a temperature between 300° F. and 160° F. and the belt is under tension of at least 20,000 psi.

11. A continuous casting apparatus in accordance with claim 1 wherein the belt is cooled to a temperature between 260° F. and 230° F.

12. A continuous casting apparatus in accordance with claim 2 wherein the cooling channels are provided only on the exit pulley.

13. A continuous casting apparatus in accordance with claim 2 wherein the channels have uniform widths and the channels are separated by uniform distances.

14. A continuous casting apparatus in accordance with claim 2 wherein the inlets and outlets of the feed and collection tubes are separated by distances which vary across the width of the pulley.

15. A continuous casting apparatus in accordance with claim 1 wherein fittings are attached to the feed tube and the collection tube, each of the fittings providing a sliding fit in the groove which minimizes leakage of liquid from the groove.

16. A continuous casting apparatus for cooling belts used in a twin belt horizontal continuous caster, comprising;

two or more pulleys to hold and move an upper belt, comprising an entry and exit pulley, two of more pulleys to hold and move a lower belt, comprising an entry and exit pulley;

the upper and lower belts having inner and outer surfaces;

the exit pulleys include a plurality of circumferential channels which are in open contact with the inner surface of the upper and lower belts, the channels run on the exterior surface of the exit pulley;

each channel comprises a liquid feed and a collection tube for liquid passage, the feed tube releases liquid, the collection tube takes up liquid, so that the liquid flows from the feed to the collection tube while contacting and cooling the inner surface of the belt;

a vacuum source operably connected to the collection tubes, pulling between 5 and 15 psia, to assist in the collection of liquid, and an optional cleaning device removing excess liquid not taken up by the collection tube from the inner surfaces of the upper and lower belts.

17. A method for cooling a belt used in continuous casting, comprising:

operating a belt caster, having entrance and exit pulleys carrying at least one belt;

flowing liquid through at least one feed tube located in at least one channel in the entrance and/or exit pulleys, each feed tube being confined by one channel;

cooling the belt, that has been heated by continuous casting, by contacting an inner surface of the belt with the liquid in the channel; and removing the liquid from the channel by vacuum assist through a collection tube.

18. A method in accordance with claim 17 wherein the pulley has an outer channel which has an outer shoulder that is higher and optionally wider than the portions the pulley which define the channels.

19. A method in accordance with claim 17 wherein a plurality of channels extend circumferentially around the surface of the pulley.

20. A method in accordance with claim 17 wherein the section of belt that is cooled is a circumferential section which extends between 180° and 30° of the pulley circumference.

21. A method in accordance with claim 17 wherein the belt is cooled to a temperature between 300° and 160° F. and the belt is under tension of at least 20,000 psi.

22. A method in accordance with claim 21 wherein the belt is cooled to a temperature between 280° and 230° F.

23. A method in accordance with claim 19 wherein the liquid is supplied only in channels in the exit pulley.

24. A method in accordance with claim 19 wherein the liquid in the channels minimizes hot spots on the belt and a strip of aluminum is cast by the belt caster.

25. A method in accordance with claim 19 wherein fittings on the feed tubes and collection tubes slidingly engage surfaces of the pulley and belt so as to minimize leakage of liquid from the grooves.

26. A method for cooling belts used in twin belt continuous casting, comprising:

operating a horizontal, twin belt caster, having entrance and exit pulleys carrying upper and lower belts;

flowing liquid through a plurality of feed tubes which are located in channels in the entrance and/or exit pulleys, each feed tube being confined by one channel;

cooling each belt, that has been heated by continuous casting, by openly contacting an inner surface of the belt with the liquid in the channel;

removing the liquid from the channel by vacuum assist through a collection tube; and optionally removing any remaining liquid on the belt by a cleaning device after the belt has left the pulley.

* * * * *